US008051773B2

(12) United States Patent
Therien

(10) Patent No.: US 8,051,773 B2
(45) Date of Patent: Nov. 8, 2011

(54) PIVOTING PRINT UNITS

(75) Inventor: Patrick J. Therien, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 511 days.

(21) Appl. No.: 12/251,433

(22) Filed: Oct. 14, 2008

(65) Prior Publication Data

US 2010/0089267 A1 Apr. 15, 2010

(51) Int. Cl.
*B41J 21/00* (2006.01)
*B41J 2/01* (2006.01)

(52) U.S. Cl. ..... 101/407.1; 347/104

(58) Field of Classification Search ..... None
See application file for complete search history.

(56) References Cited

U.S. PATENT DOCUMENTS

| | | | | |
|---|---|---|---|---|
| 5,534,897 | A | 7/1996 | Anderson et al. | |
| 5,980,136 | A * | 11/1999 | Teumer et al. | 400/521 |
| 6,637,858 | B2 | 10/2003 | Wotton et al. | |
| 2004/0080563 | A1 | 4/2004 | Leemhuis | |
| 2005/0248612 | A1 | 11/2005 | Matsuba et al. | |
| 2006/0209122 | A1 | 9/2006 | Barinaga et al. | |
| 2006/0236927 | A1 | 10/2006 | Nakamura | |
| 2007/0046724 | A1 | 3/2007 | Jung et al. | |

* cited by examiner

*Primary Examiner* — Stephen Meier
*Assistant Examiner* — Alexander C Witkowski

(57) ABSTRACT

An apparatus and method print onto a portion of a medium with one or more print units in a printing orientation and pivot the one or more print units about one or more axes non-parallel to the portion from the printing orientation to a servicing orientation.

20 Claims, 4 Drawing Sheets

PIVOTING PRINT UNITS

BACKGROUND

Servicing print units of a printer in a compact yet effective manner is difficult. For example, positioning servicing elements opposite to the print units in a print zone may result in a complex and space consuming media path.

DETAILED DESCRIPTION OF THE EXAMPLE EMBODIMENTS

Figure 1:
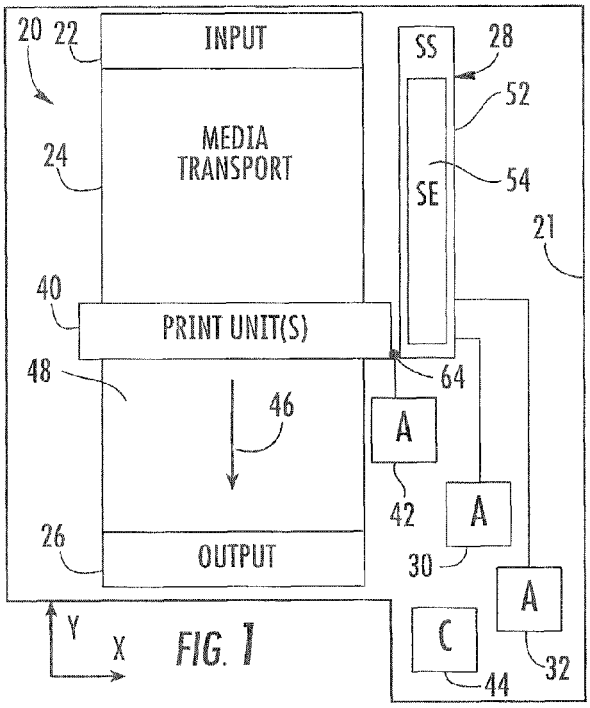
FIG. 1 is a top plan view schematically illustrating a printing system with print units in a printing orientation, according to an example embodiment.
Figure 2:
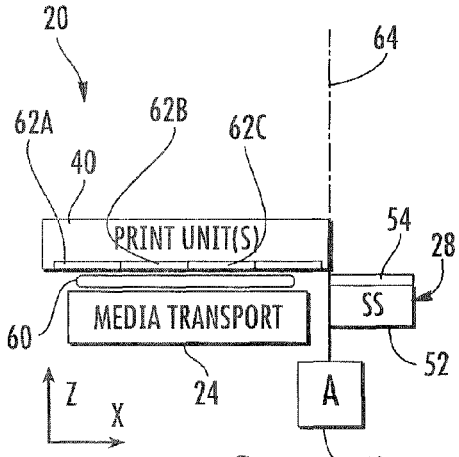
FIG. 2 is a side elevational view of the printing system of FIG. 1 according to an example embodiment.
Figure 3:
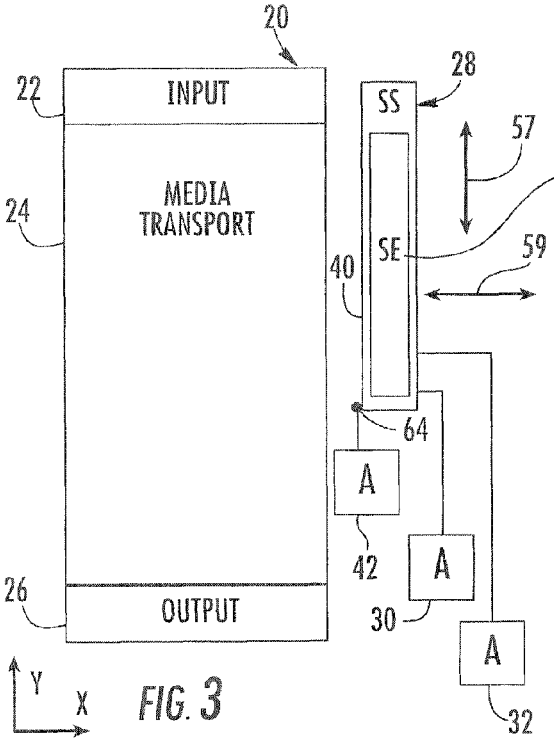
FIG. 3 is a top plan view schematically illustrating the printing system of FIG. 1 with the print units in a servicing orientation according to an example embodiment.
Figure 4:
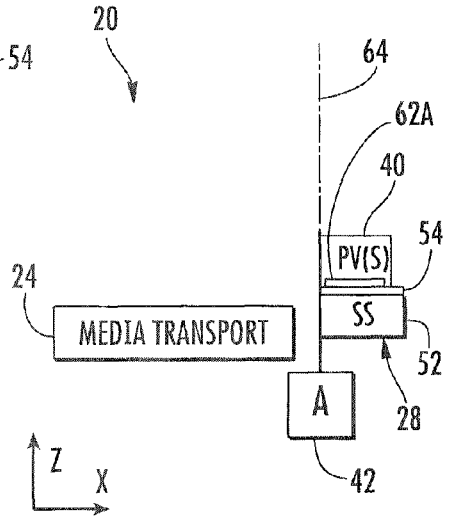
FIG. 4 is a side elevational view of the printing system of FIG. 1 according to an example embodiment.

FIGS. 1-4 schematically illustrate marking our printing system 20 according to an example embodiment. FIGS. 1 and 2 are top plan and side elevational views, respectfully, illustrating printing system 20 in a printing state. FIGS. 3 and 4 are top plan and side elevational views, respectively, illustrating printing system 20 in a servicing state. As will be described hereafter, printing system 20 facilitates effective servicing of one or more print units in a space efficient manner while maintaining positional control over the print units.

Printing system 20 includes frame 21, media input 22, media transports 24, media output 26, service station 28, actuator 30, actuator 32, one of more print units 40, actuator 42 and controller 44. Frame 21 (schematically illustrated in FIG. 1) comprises one or more structures configured to serve as a housing, frame or the like for supporting the remaining elements of printing system 20. Frame 21 may have a variety of shapes, sizes or configurations.

Media input 22 comprises a mechanism configured to supply media to media transport 24. In one embodiment, media input 22 may comprise a bin, tray or other media holding chamber and an associated pick tire that picks individual sheets from a stack within the media holding chamber and deliver such picked sheets to media transport 24. In other embodiments in which a media may comprise a web or roll of media to be printed upon, the input 22 may comprise a spool, spindle or the like.

Media transport 24 comprises a mechanism configured to receive media from input 22, to present such media to print unit(s) 40 and to transfer the printed or marked upon media to output 26. In one embodiment, media transport 24 comprises a series of one or more belts, rollers and/or media guides for directing movement of sheets or a web of media opposite to print units 40 in a direction 46 along a media path 48. Although media transport 24 is illustrated as extending just below print units 40, in other embodiments, media transport 40 may also extend above, to a side or at least partially about or around print units 40.

Media output 26 comprises a mechanism configured to receive printed or marked upon print media (also known as a substrate) from media transport 24. In one embodiment, the output 26 may comprise a bin, tray or other media storage chamber. In another embodiment which the printed upon media may comprise web or roll, the output 26 may comprise a spindle or spool. In some embodiments, media output 26 may be configured to redirect the printed upon media back to media input 22 or in other media input for duplex or two-sided printing. In still other embodiments, output 26 may be configured to such printed upon media for further processing such as binding, stapling, collating and the like.

Service station 28 comprises a mechanism configured to perform one or more servicing operations upon print units 40. For example, service station 28 may be configured to perform wiping of print units 40, to cap print units 40 or to receive printing or marketing material, such as ink, eject or spit from print units 40 during priming of print units 40. Service station 28 may additionally or alternatively be configured to sense marking material ejected from print units 40 to facilitate calibration or correction of ejection or printing characteristics of print units 40.

In the example illustrated, service station 28 generally includes a base 52 and one or more servicing elements 54 (schematically shown). Base 52 comprises one or more structures configured to serve as a foundation, sled, carriage or support for servicing elements 54. In one embodiment, base 52 is movably supported or movably coupled to the frame 21 so as, to be movable in either of the directions indicated by arrows 57 showing FIG. 3. As a result, servicing elements 54 may also be moved and guided in either the directions indicated by arrows 57. Such guided movement of base 52 is facilitated by one or more bearing structures such as roller bearings, ball bearings, low friction slides and the like (not shown). In other embodiments, base 52 may be stationarily fixed to frame 21.

Servicing elements 54 comprise one or more structures supported and carried by base 52 that are configured to perform one or more servicing operations upon print units 40. In one embodiment, servicing elements 54 may include (1) one or more flexible or elastomeric wiping blades, fluid absorbent fabrics or other materials configured to be pressed against and moved across print units 40 for wiping, (2) fluid absorbent spittoons, fluid receiving basins and/or (3) nozzle capping structures. In one embodiment, servicing elements 54 are movably supported by base 52. For example, in one embodiment, servicing elements 54 are configured to move relative to base 52 in the direction indicated by arrows 59 in FIG. 3, parallel to or substantially parallel to a lower or opposing face of print units 40. In one embodiment, servicing elements 54 comprise a web of fluid absorbent fabric material which is movable in the direction indicated by arrows 59. In one embodiment, the fabric is supported by a pair of rolls or spools while being wound and unwound in the direction indicated by arrows 59.

Actuator 30 (schematically shown) comprises a mechanism configured to move service station 28 in the directions indicated by arrows 57. In one embodiment, actuator 30 may comprise a rack gear associated with base 52 and a pinion gear rotationally driven by a motor and an associated transmission. In other embodiments, actuator 30 may utilize a motor to drive an endless belt connected to base 52 of service station 28 to translate service station 28 in the direction indicated by arrows 57. In yet other embodiments, actuator 30 may comprise mechanisms such as hydraulic or pneumatic cylinder-piston assemblies, electric solenoids and the like. In some embodiments, base 52 of service station 28 may be configured to be moved in response to manually applied force. In embodiments in which base 52 of service station 28 is not movable, actuator 30 may be omitted.

Actuator 32 comprises a mechanism supported or carried by base 52 and configured to move servicing elements 54 in the directions indicated by arrows 59. In those embodiments in which servicing elements 54 comprise a web of wiping or absorbent material, actuator 32 may comprise a motor and an associated transmission configured to drive one or both of a take-up spool or a supply spool to wind and/or unwind the web so as to move the web in at least one of the directions indicated by arrows 59. In other embodiments, actuator 32 may comprise a rack gear associated with servicing elements 54 and a pinion gear rotationally driven by a motor and an associated transmission. In other embodiments, actuator 32 may utilize a motor to drive an endless belt connected to servicing elements 54 of service station 28 to translate servicing elements 54 in the directions indicated by arrows 59. In yet other embodiments, actuator 32 may comprise mechanisms such as hydraulic or pneumatic cylinder-piston assemblies, electric solenoids and the like. In embodiments in which servicing elements 54 of service station 28 are not movable, actuator 32 may be omitted.

Print units 40 comprise one or more print units configured to print, mark or otherwise form a pattern or images upon a substrate or media supported by media transport 24. FIG. 2 illustrates one example of a print medium or substrate 60 supported by media transport 24 opposite to print units 40 in a print zone of print units 40. In the particular example illustrated, print units 40 comprise a plurality of individual print bars or print units mounted to one another so as to move in unison with one another as a single component. In other embodiments, print units 40 may comprise individual print units which move relative to one another.

As shown by FIGS. 1-4, print units 40 are movably supported by frame 21 between a printing orientation (shown in FIGS. 1 and 2) and a servicing orientation (shown in FIGS. 3 and 4). In the printing orientation, print units 40 extend over media transport 24 such that media transport 24 may position or present a medium 60 opposite to print units 40. In the example illustrated, print units 40 include one or more print units that collectively span a width of medium 60. In other words, print units 40, collectively, extend from one side edge of medium 60 to an opposite side edge of medium 60, facilitating edge-to-edge printing or marking. Although print units 40 are illustrated as extending along an axis potentially perpendicular to the direction 46 of the media path 48, in other embodiments, print units 40 may alternatively extend across media path 48 oblique to the direction indicated by arrow 46. In other embodiments, print units 40 may have a shorter collective length so as to not completely extend across and span medium 60.

In the servicing orientation shown in FIGS. 3 and 4, print units 40 extend over and opposite to servicing elements 54 of service station 28. In the example illustrated, print units 40 extend along an axis substantially parallel to the direction of media path 48 as indicated by arrows 46. As a result, print units 40 are out of media path 48 during such servicing. Because servicing station 28 is not positioned within or over media path 48, servicing station 28 may be larger without detrimentally impacting the compactness and size of media path 24 or printing system 20. In other embodiments, print units 40 may extend along other axes over service station 28 when in the servicing orientation.

As shown by FIGS. 1-4, print units 40 are configured to pivot or rotate about an axis 64 between the printing orientation and the servicing orientation. Because print units 40 are retained with respect to pivot axis 64 in both the printing orientation and the servicing orientation, pivot axis 64 serves as a datuming structure for consistently locating print units 40 in space with respect to media being printed upon and with respect to service station 28. As a result, printing quality may be enhanced.

In one embodiment, print units 40 may be pivotally supported by a shaft received within a bearings sleeve (not shown). In other embodiments, print units 40 may be pivotally supported by frame 21 in other manners. Although pivot axis 64 is illustrated as being located at the lower right-hand corner of print units 40, in other embodiments, pivot axis 64 may be provided at other locations. Although print units 40 are illustrated as pivoting in a clockwise direction from the printing orientation to the servicing orientation, in other embodiments, servicing station 28 may be on opposite side of media transport 24 such that print units 40 may alternatively pivot in a counter-clockwise direction from the printing orientation to the servicing orientation.

In one embodiment, print units 40 may comprise one or more print bars having nozzles through which liquid or fluid printing material is ejected. For example, in one embodiment, print units 40 may comprise one or more thermoresistive or piezo resistive printheads. In other embodiments, print units 40 may comprise other marking devices.

Actuator 42 comprises a mechanism configured to rotate or pivot print units 40 about axis 64. In one embodiment, actuator 42 comprises a motor, such as a stepper motor, operably coupled to print units 40 so as to selectively rotate the units 40 about axis 64 in either a clockwise direction or a counter-clockwise direction. In other embodiments, actuator 42 may comprise other mechanisms or rotary actuators configured to selectively rotate or pivot print units 40 about axis 64 between the printing orientation and the servicing orientation.

Controller 44 (schematically shown in FIG. 1) comprises one or more processing units in communication with media transport 24, print units 40, and actuator 30, 32 and 42. Controller 40 may communicate with such components in a wired fashion or in a wireless fashion. Although controller 44 is illustrated as being supported by frame 21, in other embodiments, controller 44 may be provided as part of an external device such as an external computer or another external electronic device.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 44 may be embodied as part of one or more application-specific integrated circuits (ASICs). Unless otherwise specifically noted, the controller is not limited to any specific combination of hardware circuitry and software, nor to any particular source for the instructions executed by the processing unit.

Controller 44 generates control signals directing the operation of media transport 24, print units 40 and actuator 30, 32 and 42. In operation, controller 44 generates control signals directing media transport 24 to retrieve media from input 22 at and to position a medium, such as medium 60 shown in FIG. 2, opposite to print units 40. Controller 44 further generates control signals causing actuator 42 to rotate print units 40 to the printing orientation shown in FIGS. 1 and 2. To effectuate printing or marking, controller 44 generates control signals causing print units 40 to print or mark upon medium 60. After printing has been completed, controller 44 generates control signals directing media transport 24 to move the printed upon media to media output 26.

During printing, after printing or between print jobs, controller 44 may determine that servicing of print units 40 should be performed. Controller 44 may initiate servicing of print units 40 on a predetermined set schedule, may perform servicing in response to user entered commands or may perform servicing opinions 40 in response to sensed print quality. To initiate servicing, controller 44 generates control signals directing actuator 42 to pivot print units 40 from the printing orientation shown in FIGS. 1 and 2 to the servicing orientation shown in FIGS. 3 and 4. Once print units 40 have been positioned over and opposite to service station 28, controller 44 generates control signals directing actuator 30 to move base 52 in the directions indicated by arrows 57 to effectuate servicing of the units 40 in the first direction. Controller 44 further generates control signal directing actuator 32 to move servicing elements 54 in the direction indicated by arrows 59 to effectuate servicing of units 40 in a second direction substantially perpendicular to the first direction. In those embodiments in which servicing elements 54 comprise a web of wiping material, such movement in the first and second directions occurs while the web is in contact with print units 42 wipe the nozzles of print units 40. Consequently, printing system 20 performs both orthogonal (longitudinal) wiping and cross wiping of print units 40.

In one embodiment, controller 44 may further be configured to direct actuator 30, actuator 32 or another lift or actuator (not shown) to move base 52 or portions of servicing elements 54 in a direction so that you perpendicular to a lower face up in units 40 (in the Z axis direction shown in FIG. 2). For example, controller 44 may generate control signals raising or lowering a capping structure relative to a lower face of print units 42 to cap or uncap print units 40.

Overall, because print units 40 pivot out of media path 48 for servicing, service station 28 does not occupy valuable space along media path 48 and does not complicate media path 48. In addition, because service station 28 is not constrained by media path 48, service station 28 may be larger. For example, service station 28 may include a larger basin or a larger web for containing liquid or ink ejected during priming.

FIGS. 5-10 illustrate printing system 120, a particular embodiment of printing system 20. As with printing system 20, printing system 120 includes frame 121 (schematically shown in FIG. 1), actuator 30, actuator 32, actuator 42 and controller 44. Printing system 120 also includes media input 122, media transport, media output 126, service station 128, print units 140, particular embodiments of media input 22, media transport 24, media output 26, service station 28 and print units 40, respectfully.

Media input 122 comprises a mechanism configured to supply media to media transport 124. In the example illustrated, media input 122 comprises a bin, tray or other media holding chamber and an associated pick tire that picks individual sheets from a stack within the media holding chamber and deliver such picked sheets to media transport 24.

Figure 5:
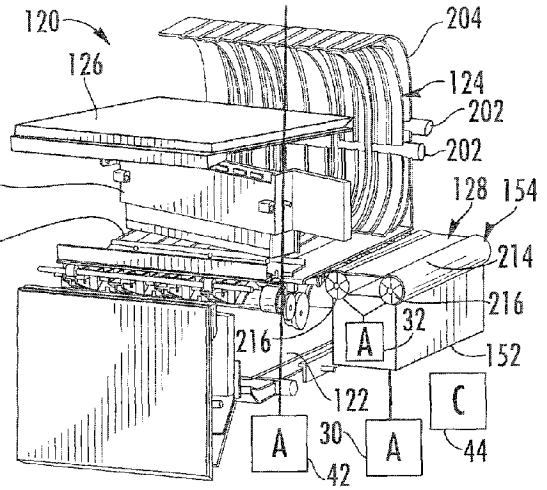
FIG. 5 is a perspective view of another embodiment of the printing system of FIG. 1 illustrating print units in a printing orientation according to an example embodiment.

Media transport 124 comprises a mechanism configured to receive media from input 22, to present such media to print unit(s) 40 and to transfer the printed or marked upon media to output 26. In the example illustrated, media transport 124 comprises a series of one or more rollers 202 and media guides 204 for directing movement of sheets media opposite to print units 40 in a direction 146 along a media path 48. As shown by FIG. 5, transport 124 move sheets of media from input one on 22 below a media platen 210 to a position upon media platen 210 opposite to print units 140. Thereafter, media transport 124 moves the sheet of media to position above print units 140 onto media output 126. In other embodiments, media transport 124 may have other configurations.

Media output 126 comprises a mechanism configured to receive printed or marked upon print media (also known as a substrate) from media transport 124. In the embodiment illustrated, media output 126 comprises a bin, tray or other media storage chamber. In other embodiments, media output 26 may be configured to redirect the printed upon media back to media input 122 or in other media input for duplex or two-sided printing. In still other embodiments, output 126 may be configured to such printed upon media for further processing such as binding, stapling, collating and the like.

Service station 128 comprises a mechanism configured to perform one or more servicing operations upon print units 140. For example, service station 128 may be configured to perform wiping of print units 140 or to receive marking material, such as ink, ejected or spit from print units 140 (priming). Service station 128 may additionally or alternatively be configured to contact marking material ejected from print units 140 to facilitate calibration or correction of ejection or printing characteristics of print units 140.

In the example illustrated, service station 128 generally includes a base 152 and one or more servicing elements 154. Base 152 comprises one or more structures configured to serve as a foundation, sled, carriage or support for servicing elements 154. In the embodiment illustrated, base 152 is movably supported or movably coupled to the frame 21 (schematically shown FIG. 1) so as to be movable in either the directions indicated by arrows 157 showing FIG. 9. As a result, servicing elements 154 may also be moved in either the directions indicated by arrows 157. Such guided movement of base 152 is facilitated by one or more bearing structures such as roller bearings, ball bearings, low friction slides and the like (not shown) positioned between base 152 and frame 21. In other embodiments, base 152 may be stationarily fixed to frame 121.

Servicing elements 154 comprise one or more structures supported and carried by base 152 that are configured to perform one or more servicing operations upon print units 140. In the embodiment illustrated, servicing elements 154 comprise a web 214 of fluid absorbent fabric material which is movable in the direction indicated by arrows 159 (shown in FIG. 10). In the embodiment illustrated, the web 214 is supported by a pair of spaced rolls or spools 216 while being wound and unwound in the direction indicated by arrows 218 (shown in FIG. 10).

Print units 140 comprise one or more print units configured to print, mark or otherwise form a pattern or images upon a substrate or media supported by media transport 124. In one embodiment, print units 140 may comprise one or more print bars having nozzles through which liquid or fluid printing material is ejected. For example, in one embodiment, print units 140 may comprise one or more thermoresistive or piezo resistive printheads. In other embodiments, print units 140 may comprise other marking devices. In the particular example illustrated, print units 140 comprise a plurality of individual print bars or print units mounted to one another so as to move in unison with one another as a single component.

Figure 6:
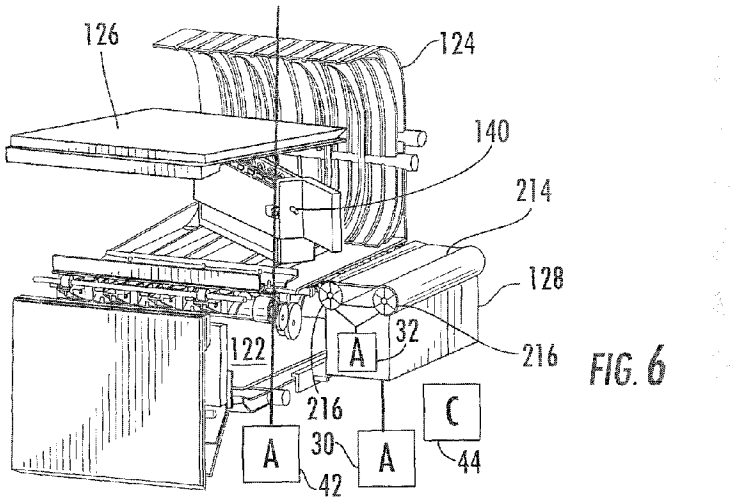
FIGS. 6 and 7 are perspective views illustrating the printing units of FIG. 5 being rotated or pivoted towards a servicing orientation according to an example embodiment.
Figure 8:
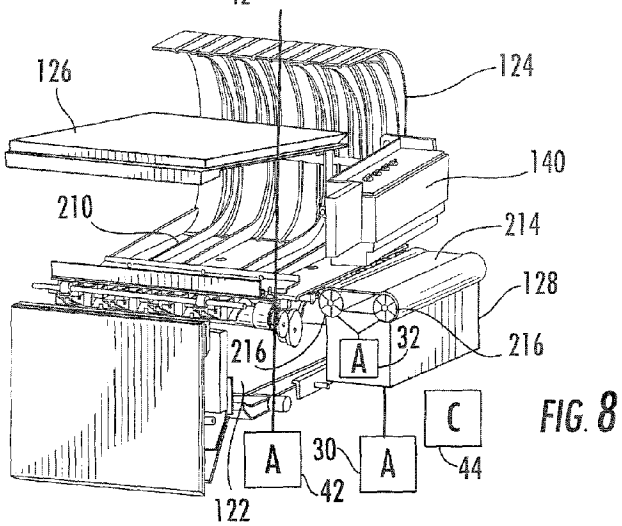
FIG. 8 is a perspective view illustrating the print units of the pretty system of FIG. 5 in the servicing orientation according to an example embodiment.
Figure 7:
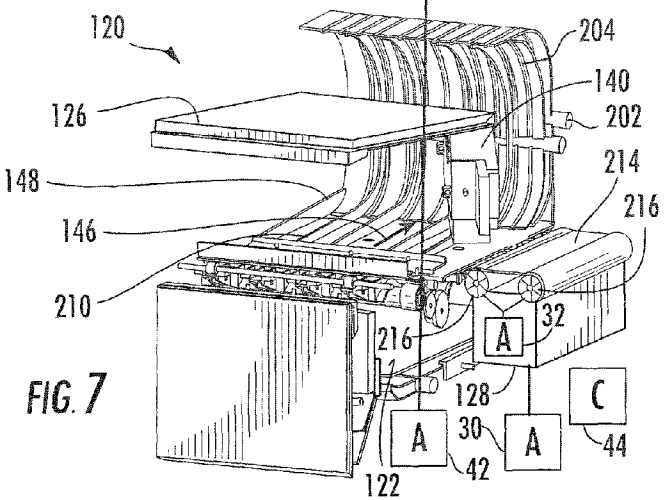

As shown by FIGS. 5-8, print units 140 are movably supported between a printing orientation (shown in FIG. 5) and a servicing orientation (shown in FIG. 8). FIGS. 6 and 7 illustrate pivoting or rotation of print units 140 between the printing orientation and the servicing orientation. In one embodiment, print units 140 may be pivotally supported by a shaft received within a bearings sleeve (not shown). In other embodiments, print units 140 may be pivotally supported by frame 21 in other manners. Because print units 140 are retained with respect to pivot axis 164 in both the printing orientation and the servicing orientation, pivot axis 64 serves as a datuming structure for consistently locating print units 140 in space with respect to media being printed upon and with respect to service station 128. As a result, printing quality may be enhanced.

Although pivot axis 164 is illustrated as being located at the lower right-hand corner of print units 140, in other embodiments, pivot axis 164 may be provided at other locations. Although print units 140 are illustrated as pivoting in a clockwise direction from the printing orientation to the servicing orientation, in other embodiments, servicing station 128 may be on opposite side of media transport 124 such that print units 140 may alternatively pivot in a counter-clockwise direction from the printing orientation to the servicing orientation.

As shown by FIG. 5, in the printing orientation, print units 140 extend over media transport 124 such that media transport 124 may position or present a medium opposite to print units 140. In the example illustrated, print units 140 include one or more print units that collectively span a width of the media path 148. As a result, print units 140, collectively, extend from one side edge of a medium to be printed upon to the opposite side edge of the medium to be printed upon, facilitating edge-to-edge printing or marking. Although print units 40 are illustrated as extending along an axis oblique to the direction 146 of the media path 148, in other embodiments, or units 40 may alternatively perpendicularly extend across media path 148. In other embodiments, print units 140 may have a shorter collective length so as to not completely extend across and span the medium being printed upon.

In the servicing orientation shown in FIG. 8, print units 140 extend over and opposite to servicing elements 154 of service station 128. In the example illustrated, print units 140 extend along an axis substantially parallel to the direction of media path 148 as indicated by arrows 146. As a result, print units 140 are out of media path 148 during such servicing. Because servicing station 128 is not positioned within or over media path148, servicing station 128 may be larger without detrimentally impacting the compactness and size of media path 124 or printing system 120. In other embodiments, print units 140 may extend along other axes over service station 128 when in the servicing orientation.

In operation, controller 44 generates control signals directing media transport 124 to retrieve media from input 122 and position the retrieved medium, such as medium 60 shown in FIG. 2, opposite to print units 140. Controller 44 further generates control signals causing actuator 142 to rotate print units 142 the printing orientation shown in FIG. 5. To effectuate printing or marking, controller 44 generates control signals causing print units 140 to print or mark upon the medium. After printing has been completed, controller 144 generates control signals directing media transport 124 to move the printed upon media to media output 126.

During printing, after printing or between print jobs, controller 44 may determine that servicing of print units 140 should be performed. Controller may initiate the servicing of print units 140 on a predetermined set schedule, may perform servicing in response to user entered commands or may perform servicing opinions 140 in response to sensed print quality. To initiate servicing, controller 44 generates control signals directing actuator 142 to pivot print units 140 from the printing orientation shown in FIG. 5 to the servicing orientation shown in FIGS. 8-10.

Figure 9:
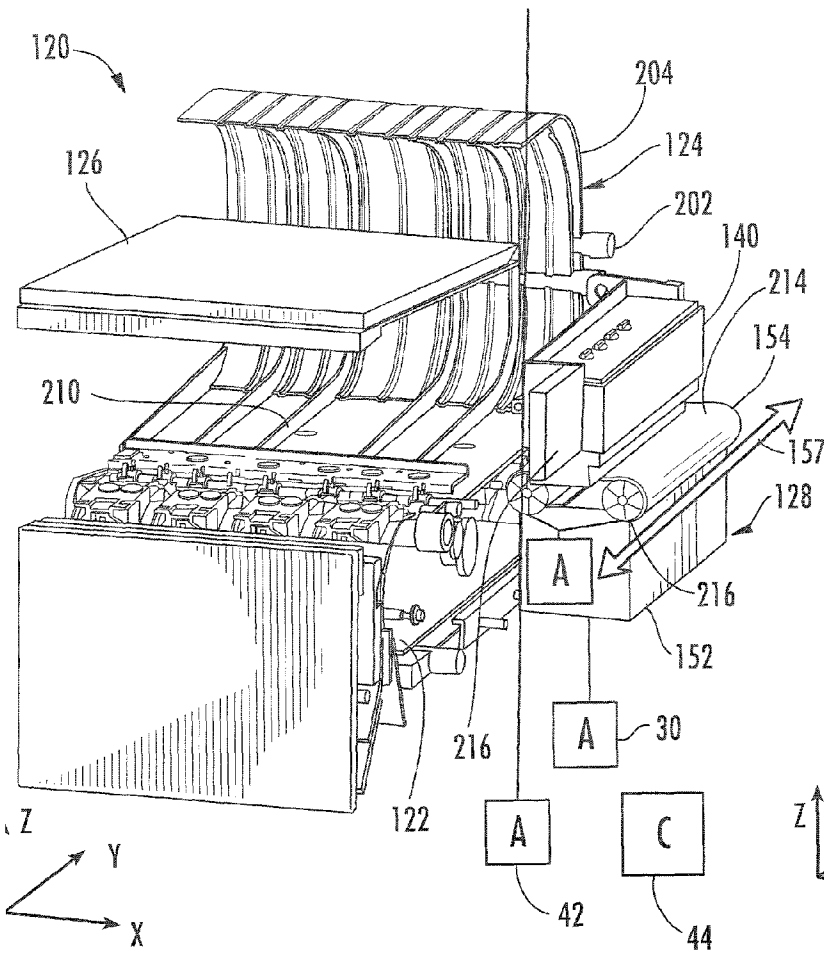
FIG. 9 is a perspective view of the printing system of FIG. 1 illustrating servicing in a first direction while the print unit is in the servicing orientation according to an example embodiment.

As shown by FIG. 9, once print units 140 have been positioned over and opposite to service station 128, controller 44 generates control signals directing actuator 130 to move base 152 in the directions indicated by arrows 157 to effectuate servicing of the units 140 in the first direction. Controller 44 further generates control signal directing actuator 32 to move servicing elements 154 in the direction indicated by arrows 159 to effectuate servicing of units 140 in a second direction substantially perpendicular to the first direction. In those embodiments in which servicing elements 154 comprise a web of wiping material, such movement in the first and second directions occurs while the web is in contact with print units 140 to wipe the nozzles of print units 140. Consequently, printing system 120 performs both orthogonal (longitudinal) wiping and cross wiping of print units 140.

Figure 10:
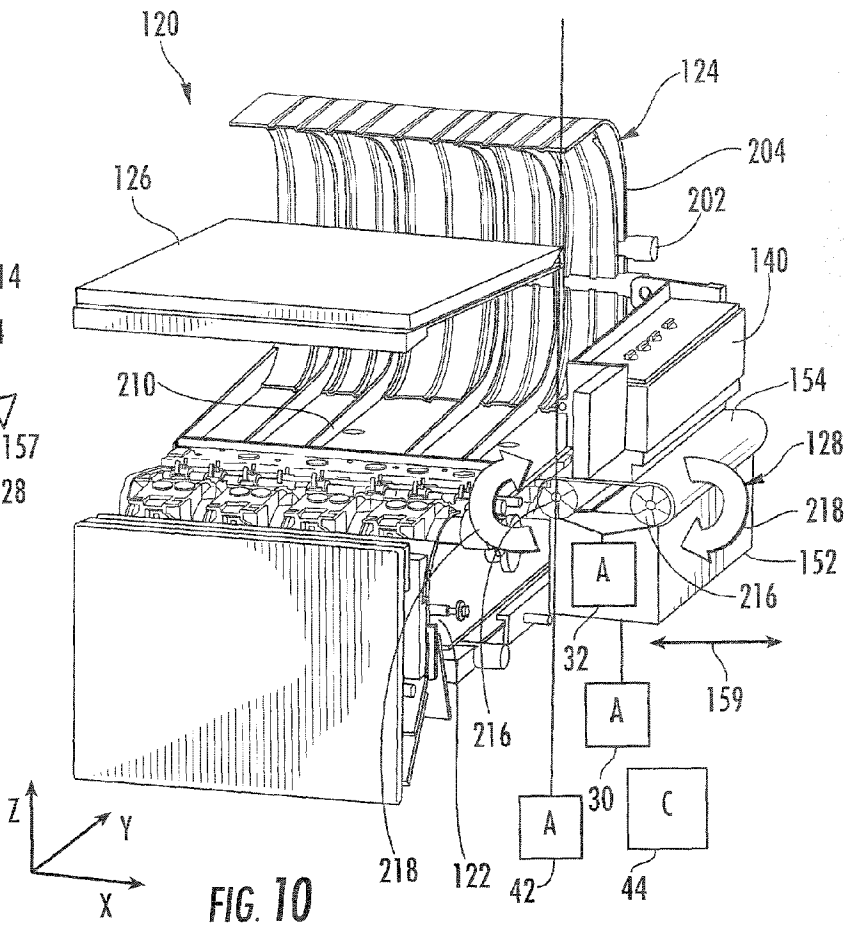
FIG. 10 is a perspective view of the printing system of FIG. 1 illustrating servicing in a second direction while the print unit is in the servicing orientation according to an example embodiment.

In one embodiment, controller 44 may further be configured to direct actuator 30, actuator 32 or another lift or actuator (not shown) to move base 152 or portions of servicing elements 154 in a direction substantially perpendicular to a lower face of print units 140 (in the Z axis direction shown in FIG. 10). For example, controller 44 may generate control signals raising or lowering of capping structure relative to a lower face of print units 140 to cap or uncap print units 140.

Overall, because print units 140 pivot out of media path 48 for servicing, service station 128 does not occupy valuable space along media path 148 and does not complicate media path 148. In addition, because service station 128 is not constrained by media path148, service station 128 may be larger. For example, service station 128 may include a larger basin or a larger web for containing liquid or ink ejected during priming.

FIGS. 11-15 illustrate printing system 320, another embodiment of printing system 20. Like printing system 20, printing system 320 is configured to print across a substantial width of a medium. Like printing system 20, printing system 320 is further configured to rotate one or more printing units about pivot axis non-parallel to the portion of the medium being printed upon so as to rotate the one or more print units between a printing orientation and a servicing orientation. Like printing system 20, printing system 320 facilitates servicing of the one or more print units in a space efficient manner.

Figures 11, 12, 13, 14, 15:
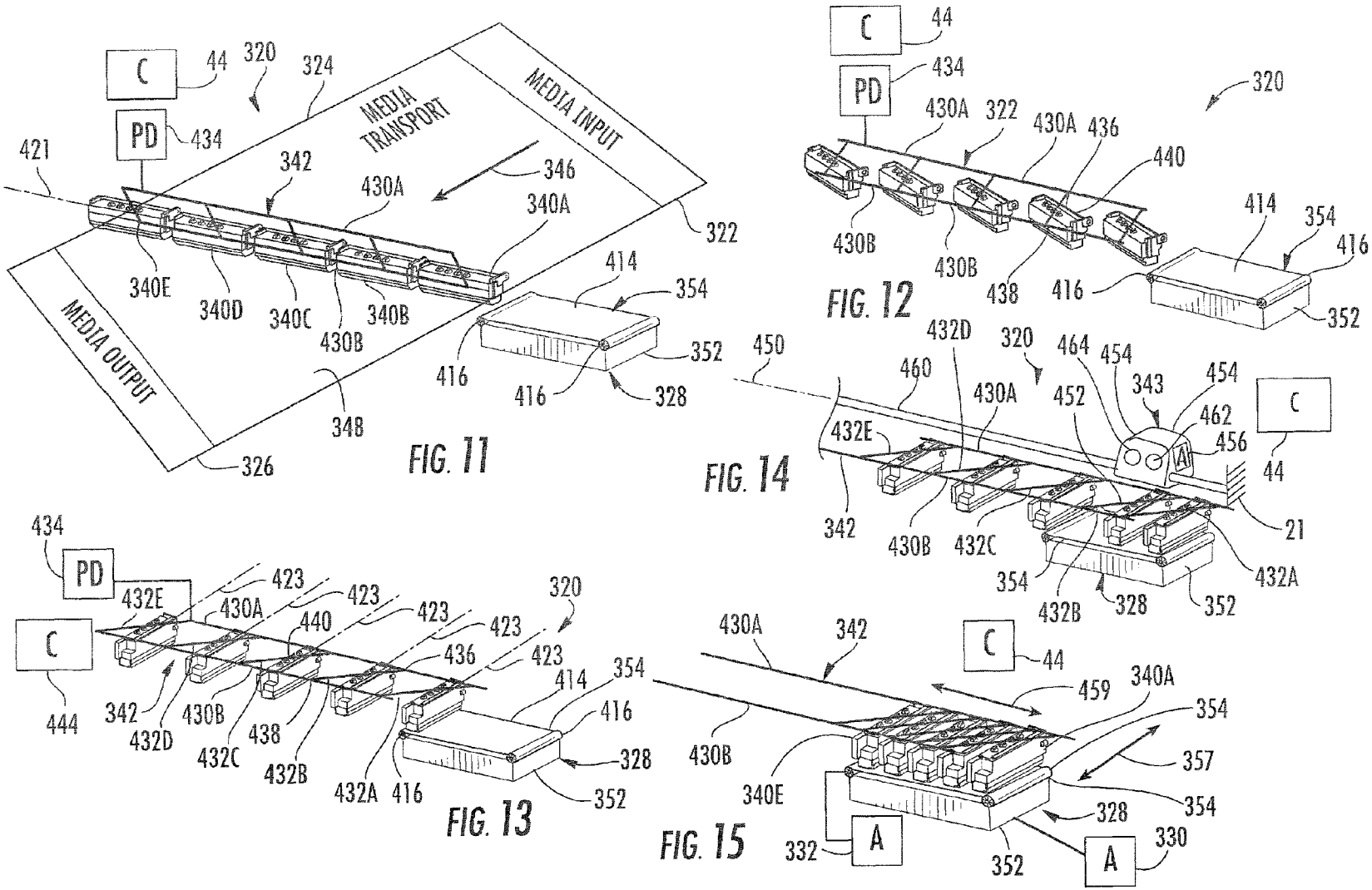
FIG. 11 is a perspective view of another embodiment of the printing system of FIG. 1 illustrating printing units in a printing orientation according to an example embodiment.
FIG. 12 is a perspective view of the printing system of FIG. 11 illustrating pivoting of the printing units towards a servicing orientation according to an example embodiment.
FIG. 13 is a perspective view of the printing system of FIG. 11 illustrating the printing unit in a servicing orientation.
FIG. 14 is a perspective view of the printing system of FIG. 13 illustrating the printing units being positioned opposite to a servicing station according to an example embodiment.
FIG. 15 is a perspective view of the printing system of FIG. 11 with the print units compactly positioned opposite to a service station during servicing of the print units according to an example embodiment.

Printing system 320 includes media input 322, media transport 324, media output 326, all of which are shown in FIG. 11, servicing station 328, actuator 330 (shown in FIG. 15), actuator 332 (shown in FIG. 15), print units 340A, 340B, 340C, 340D, 340E (collectively referred to as print units 340), actuator 342, racking mechanism 343 (shown in FIG. 14) and controller 344. Media input through 24, media transport 324 and media output 326 are substantially similar to media input 22, media transport 24 and media output 26, respectively.

Media input 322 comprises a mechanism configured to supply media to media transport 324. In one embodiment, media input 322 may comprise a bin, tray or other media holding chamber and an associated pick tire that picks individual sheets from a stack within the media holding chamber and deliver such picked sheets to media transport 324. In other embodiments in which a media may comprise a web or roll of media to be printed upon, the input 322 may comprise a spool, spindle or the like.

Media transport 324 comprise a mechanism configured to receive media from input 22, to present such media to print unit(s) 340 and to transfer the printed or marked upon media to output 326. In one embodiment, media transport 324 comprises a series of one or more belts, rollers and/or media guides for directing movement of sheets or a web of media opposite to print units 340 in a direction 346 along a media path 348. Although media transport 324 is illustrated as extending just below print units 340, in other embodiments, media transport 340 may also extend above, to a side or at least partially about or around print units 340.

Media output 326 comprises a mechanism configured to receive printed or marked upon print media (also known as a substrate) from media transport 324. In one embodiment, the output 326 may comprise a bin, tray or other media storage chamber. In another embodiment in which the printed upon media may comprise web or roll, media output 326 may comprise a spindle or spool. In some embodiments, media output 326 may be configured to redirect the printed upon media back to media input 322 or in other media input for duplex or two-sided printing. In still other embodiments, output 26 may be configured to such printed upon media for further processing such as binding, stapling, collating and the like.

Service station 328 comprises a mechanism configured to perform one or more servicing operations upon print units 340. For example, service station 28 may be configured to perform wiping up at units 40 or receiving printing or marketing material, such as ink, eject or spit from print units 340 (priming of print units 340). Service station 328 may additionally or alternatively be configured to contact marking material ejected from print units 340 to facilitate calibration or correction of ejection or printing characteristics of print units 340.

In the example illustrated, service station 328 generally includes a base 352 and one or more servicing elements 354. Base 152 comprises one or more structures configured to serve as a foundation, sled, carriage or support for servicing elements 354. In the embodiment illustrated, base 352 is movably supported or movably coupled to the frame 21 (schematically shown FIG. 1) so as to be movable in either the directions indicated by arrows 357 showing FIG. 15. As a result, servicing elements 354 may also be moved in either the directions indicated by arrows 357. Such guided movement of base 352 is facilitated by one or more bearing structures such as roller bearings, ball bearings, low friction slides and the like (not shown) positioned between base 352 and frame 21. In other embodiments, base 352 may be stationarily fixed to frame 21.

Servicing elements 354 comprise one or more structures supported and carried by base 352 that are configured to perform one or more servicing operations upon print units 340. In the embodiment illustrated, servicing elements 354 comprise a web 414 of fluid absorbent fabric material which is movable in the direction indicated by arrows 459 (shown in FIG. 10). In the embodiment illustrated, the web 214 is supported by a pair of spaced rolls or spools 416 while being wound and unwound to move the web in the directions indicated by arrows 459.

Print units 340 comprise print units configured to print, mark or otherwise form a pattern or images upon a substrate or media supported by media transport 324. In one embodiment, print units 340 may comprise one or more print bars having nozzles through which liquid or fluid printing material is ejected. For example, in one embodiment, print units 340 may comprise one or more thermoresistive or piezo resistive printheads. In other embodiments, print units 340 may comprise other marking devices.

Print units 340 start each fixedly connected to a portion of actuator 342. Each of print units 340 pivots between a printing orientation (shown in FIG. 11 and a servicing orientation (shown in FIGS. 13-15). In the servicing orientation shown in FIG. 11, print units 340 are substantially aligned on a single axis 421 so as to extend end-to-end across media path 348. Axis 421 extends substantially perpendicular to media path 348 in the direction indicated by arrows 346. In other embodiments, print units 340 may alternatively obliquely extend across media path 348 in the printing orientation.

In the example illustrated, print units 340, collectively, span an entire width of media to be printed upon. In the example illustrated, print units 340, collectively, span an entire width of the media path 348 from one edge to the opposite edge. As a result, an entire width of a print medium or substrate may be printed upon during a single pass of the medium or substrate along media path 348. In other embodiments, print units 340 may extend only partially across media path 348.

As shown by FIGS. 13-15, in the servicing orientation, print units 340 are rotated so as to extend along distinct multiple axes 423 substantially perpendicular to axis 421. As shown by FIGS. 14 and 15, when rotated to the servicing orientation, print units 340 extend parallel to one another so that they may be moved to a more compact arrangement opposite to service station 328 by racking mechanism 343.

Actuator 344 comprises a mechanism configured to rotate print units 340 between the printing orientation and the servicing orientation. Actuator 342 includes rails 430A, 430B (collectively referred to as rails 430), rungs 432A, 432B, 432C, 432D and 432E (collectively referred to as rungs 432) and pivot drive 434. Rails 430 slightly and rotatably support each of rungs 432. Rungs 432 extend between rails 430. Each rung 432 has a first end portion 436 slidably and pivotally connected to one of rails 430 and a second end portion 438 slidably and pivotally connected to the other of rails 430. Each rung 432 has an intermediate or central portion 440 fixed (against rotation) to a central portion of a corresponding print unit 340 such that pivoting of rungs 432 causes corresponding rotation or pivoting of print units 340.

Pivot drive 434 comprises a mechanism couple to at least one of rails 430 to the linearly translate one of rails 430. As shown by Figures and 13, as pivot drive 434 linearly translates one of rails 430 relative to the other rails 430, rungs 432 pivot about center portion 940, pivoting or rotating print units 340 relative to one another and relative to rails 340. In one embodiment, pivot drive 434 may comprise an electric solenoid. In another embodiment, pivot drive 434 may comprise other linear actuators such as a hydraulic or pneumatic cylinder-piston assembly or one or more cam driven levers that are driven by a motor.

Racking mechanism 343 comprises a mechanism configured to individually pull, push or otherwise slide print units 340 along rails 340. In the example illustrated, racking mechanism 343 is movably supported along an axis 450 substantially parallel to the axes of rails 430. Racking mechanism 343 includes an extendable and retractable finger, bar, or paddle 452 which moves between an extended position in which paddle 452 projects between consecutive print units 340 and a retracted position withdrawn from between consecutive print units 340. As shown by FIGS. 14 and 15, by selectively extending and retracting paddle 452 and by selectively moving mechanism 343 along axis 450, racking mechanism 343 may selectively push and slide print units 340 along rails 430 to adjust the spacing between consecutive printing units 340. In particular, as shown by FIG. 15, racking mechanism 343 may position print units 340 in a compact side-to-side position along rails 430 and opposite to service station 328. As a result, each of print units 340 may be serviced while being closely position in space with respect to an adjacent print unit 340. This facilitates a smaller, more compact servicing station 328 and facilitates faster servicing of print units 340.

According to one embodiment, racking mechanism 343 includes body 454, actuator 456, rack gear 460, pinion gear 462 and motor 464, extending along axis 450 and a pinion gear 452 carried by body 46 for a racking mechanism 343. Body 454 comprises a structure carrying paddle 452, actuator 456, pinion gear 462 and motor 464.

Actuator 456 comprises a mechanism to selectively extend and retract paddle 452. In one embodiment, actuator 456 comprises an electric solenoid. In other embodiments, other mechanisms may be used to selectively extend and retract paddle 452. In one embodiment, paddle 452 linearly extends and retracts. In another embodiment, paddle 45 to rotate or pivots between an extended and retracted position.

Rack gear 460 extends along axis 450. Pinion gear 462 is coupled to body 464 and has teeth in meshing engagement with rack gear 460. Motor 464 is carried by body 454 and is configured to rotationally drive pinion gear 462 so as to move body 454 along axis 450 of rack gear 460. In other embodiments, racking mechanism 343 may have other configurations.

In operation, controller 44 generates control signals directing media transport 324 to retrieve media from input 322 and position the retrieved medium, such as medium 60 shown in FIG. 2, opposite to print units 340 while print units 340 are in the printing orientation shown in FIG. 11. To effectuate printing or marking, controller 44 generates control signals causing print units 340 to print or mark upon the medium. After printing has been completed, controller 344 generates control signals directing media transport 324 to move the printed upon media to media output 326.

During printing, after printing or between print jobs, controller 44 may determine that servicing of print units 340 should be performed. Controller may initiate the servicing of print units 340 on a predetermined set schedule, may perform servicing in response to user entered commands or may perform servicing of print units 340 in response to sensed print quality. To initiate servicing, controller 44 generates control signals directing pivot drive 4342 linearly move one of rails 430 relative to the other of rails 430 to pivot print units 340 from the printing orientation shown in FIG. 11 to the servicing orientation shown in FIG. 13.

As shown by FIGS. 14 and 15, once print units 340 have been positioned in the servicing orientations, controller 344 generates control signals directing racking mechanism 343 to selectively extend and attract paddle 452 and to move paddle 45 to along axis 450 so as to slide each of print units 340 along rails 430 to positions opposite to service station 328. As shown by FIG. 15, print units of the 340 or compactly arranged opposite to service station 328.

As shown by FIG. 15, once print units 340 have been positioned over and opposite to service station 328, controller 44 generates control signals directing actuator 330 to move base 352 in the directions indicated by arrows 357 to effectuate servicing of the units 340 in the first direction. Controller 44 further generates control signal directing actuator 332 to move servicing elements 354 in the direction indicated by arrows 359 to effectuate servicing of units 140 in a second direction substantially perpendicular to the first direction. In those embodiments in which servicing elements 354 comprise a web of wiping material, such movement in the first and second directions occurs while the web 414 is in contact with print units 340 to wipe the nozzles of print units 340. Consequently, printing system 320 performs both orthogonal (longitudinal) wiping and cross wiping of print units 340.

One servicing has been completed, controller 44 generates control signals causing racking mechanism 343 to selectively extend paddle 452 and to move paddle for far too along axis 450 so as to push and slide each of print units 340 along rails 430 to appropriate positions along rails 430 along, over and opposite to media path 348 (shown in FIG. 11). Thereafter, controller 44 generates control signals causing pivot drive 434 to linearly translate one of rails 430 relative to the other rails 430 to pivot print units 430 from the servicing orientation back to the printing orientation shown in FIG. 11. Print units 430 are ready for printing on a print medium or substrate.

Overall, because print units 440 move out of media path 348 for servicing, service station 328 does not occupy valuable space along media path 348 and does not complicate media path 348. In addition, because service station 328 is not constrained by media path 348, service station 328 may be larger. For example, service station 328 may include a larger basin or a larger web for containing liquid or ink ejected during priming.

In addition, printing system 320 is more easily scaled or enlarged or reduced. For example, to increase a width of media that may be accommodated during a single pass of the media, additional print units 440 maybe added along rails 430. Likewise, if the media path is to be narrower, some of print units 440 may be removed from rails 430.

Depending upon the number of print units 440 that are to be serviced, an additional service station 328 may be provided. For example, although printer 320 is illustrated as having a single service station 328 on one side of media path 348, in other embodiments, printer 320 may include an additional second service station 328 on an opposite side of media path 348. In such an embodiment, racking mechanism 343 may rack a portion of print units 440 opposite a first one of servicing stations 328 and a second portion of print units 440 opposite to the second one of service stations 328. This may reduce the overall time utilized for servicing all of the printed 440. In some embodiments, printer 320 may include a second racking mechanism 343 four racking a portion of print units 440 opposite to the second service station 328.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements

What is claimed is:

1. An apparatus comprising:

one or more printing units configured to print fluid onto a portion of a medium, wherein the one or more printing units is configured to pivot about one or more axes non-parallel to the portion between a printing orientation and a servicing orientation.

2. The apparatus of claim 1, wherein the one or more printing units, collectively, span a width of the medium.

3. The apparatus of claim 1, wherein the one or more printing units pivot about a single axis non-parallel to the portion between the printing orientation and the servicing orientation.

4. The apparatus of claim 1, wherein the one or more printing units pivot about a plurality of axes non-parallel to the portion between the printing orientation and the servicing orientation.

5. The apparatus of claim 1, wherein the one or more printing units comprise a plurality of printing units.

6. The apparatus of claim 5 further comprising:

a first rail;

a second rail; and a plurality of rungs, each rung having a first portion pivotally connected to the first rail, a second portion pivotally connected to the second rail and an intermediate portion fixed to one of the plurality of printing units.

7. The apparatus of claim 6, wherein each rung is slidable along the first rail and the second rail.

8. The apparatus of claim 7, wherein each of the plurality of printing units is slidable from a first spacing with respect to an adjacent printing unit to a second spacing with respect to an adjacent printing unit, the second space in being smaller than the first spacing.

9. The apparatus of claim 5, wherein the portion comprises a surface of the medium, and wherein each of the plurality of printing units is pivotably supported for pivotal movement about an associated axis perpendicular to the surface between the printing orientation and the servicing orientation.

10. The apparatus of claim 9 further comprising a service station configured to wipe the one or more printheads, wherein each of the plurality of printing units is slidable between a first position opposite to the medium and a second position opposite to the service station.

11. The apparatus of claim 1 further comprising a servicing station, wherein the one or more print units pivot about the one or more axes from a first position opposite to the medium to a second position opposite to the servicing station.

12. The apparatus of claim 11, wherein the medium moves in a first direction opposite to the one of more printing units when the one or more print units are in the printing orientation during printing and wherein the service station is configured to move in the first direction opposite to the one of more printing units when the printing units are in the servicing orientation during servicing.

13. The apparatus of claim 12, wherein the servicing station includes servicing elements configured to move in a second direction perpendicular to the first direction opposite to the one or more printing units when the one or more printing units are in the servicing orientation.

14. The apparatus of claim 13, wherein the servicing elements comprise a web of servicing material.

15. The apparatus of claim 14, wherein the web of servicing material winds and unwinds in a direction perpendicular to the first direction.

16. The apparatus of claim 15, wherein the web is configured to wind and unwind while in contact with the one or more printheads.

17. The apparatus of claim 14, wherein the web of servicing material comprises a first roll, a second roll and a span of the servicing material between the first roll and the second roll, wherein the span is configured to contact the one or more printing units to wipe the one or more printing units during servicing of the one or more printing service units while the one or more printing units are in the servicing orientation.

18. The apparatus of claim 1, wherein the portion comprises a surface of the medium, and wherein the one or more printing units comprises a printing unit pivotably supported for pivotal movement about an axis perpendicular to the surface between the printing orientation and the servicing orientation.

19. A method comprising:

printing onto a portion of a medium with one or more print units in a printing orientation; and pivoting the one or more print units about one more axes non-parallel to the portion from the printing orientation to a servicing orientation.

20. An apparatus comprising:

a plurality of printing units, each printing unit being pivotable about an associated axis between a printing orientation and a servicing orientation;

a first rail;

a second rail; and a plurality of rungs, each rung having a first portion pivotally connected to the first rail, a second portion pivotally connected to the second rail and an intermediate portion fixed to one of the plurality of printing units.

* * * * *

UNITED STATES PATENT AND TRADEMARK OFFICE

CERTIFICATE OF CORRECTION

PATENT NO. : 8,051,773 B2
APPLICATION NO. : 12/251433
DATED : November 8, 2011
INVENTOR(S) : Patrick J. Therien It is certified that error appears in the above-identified patent and that said Letters Patent is hereby corrected as shown below:

In column 13, line 53, in Claim 8, delete "in" and insert -- is --, therefor.

In column 14, line 11, in Claim 12, delete "one of more" and insert -- one or more --, therefor.

In column 14, line 14, in Claim 12, delete "one of more" and insert -- one or more --, therefor.

In column 14, line 46, in Claim 19, delete "one more" and insert -- one or more --, therefor.

Signed and Sealed this
Thirty-first Day of July, 2012

David J. Kappos

David J. Kappos
*Director of the United States Patent and Trademark Office*